US010011423B2

(12) United States Patent
Henken et al.

(10) Patent No.: US 10,011,423 B2
(45) Date of Patent: Jul. 3, 2018

(54) CUTTING APPARATUS AND ASSOCIATED SYSTEMS

(71) Applicant: Medline Industries, Inc., Mundelein, IL (US)

(72) Inventors: Megan Henken, Wauconda, IL (US); Derek Roberts, Chicago, IL (US); Brendan Fong, Riverwoods, IL (US); Alex Hay, Chicago, IL (US)

(73) Assignee: Medline Industries, Inc., Northfield, IL (US)

( * ) Notice: Subject to any disclaimer, the term of this patent is extended or adjusted under 35 U.S.C. 154(b) by 423 days.

(21) Appl. No.: 14/828,268

(22) Filed: Aug. 17, 2015

(65) Prior Publication Data

US 2017/0050404 A1 Feb. 23, 2017

(51) Int. Cl.

| | |
|---|---|
| ***B65F 1/06*** | (2006.01) |
| ***B65B 51/04*** | (2006.01) |
| ***B65F 1/16*** | (2006.01) |

(52) U.S. Cl.

CPC ..... *B65F 1/068* (2013.01); *B65B 51/04* (2013.01); *B65F 1/062* (2013.01); *B65F 1/163* (2013.01); *B65F 1/1607* (2013.01); *B65F 2210/126* (2013.01); *B65F 2210/167* (2013.01); *B65F 2250/11* (2013.01); *B65F 2250/114* (2013.01)

(58) Field of Classification Search

CPC .. B65B 9/12; B65B 9/15; B65B 51/04; B65B 51/046; B65B 51/05; B65B 67/1211; B65B 67/1266; B65B 67/1277; B65B 2067/1283; B65F 2210/167; B65F 2210/126; Y10T 29/53783; Y10T 29/53787

USPC ..... 53/138.1–138.4, 567, 576; 29/243.56, 29/243.57

See application file for complete search history.

(56) References Cited

U.S. PATENT DOCUMENTS 1,712,454 A * 5/1929 Spencer ..... B65B 51/04 493/302
2,831,302 A * 4/1958 Jensen et al. ..... B65B 51/04 53/138.4
2,864,213 A * 12/1958 Carter ..... B65B 9/13 53/459

(Continued)

FOREIGN PATENT DOCUMENTS

DE 1078042 B * 3/1960 ..... B65B 9/15
DE 3100241 A1 * 1/1982 ..... B65B 51/04

(Continued)

*Primary Examiner* — Stephen F Gerrity
(74) *Attorney, Agent, or Firm* — Philip H. Burrus, IV

(57) ABSTRACT

A cutting device (200) includes a receiver (404) and a translating head (403). The receiver includes a mounting plate (407) with a first fastener delivery device (307) and a second fastener delivery device (308) coupled thereto. A first gatherer (410) and a second gatherer (411) each extend distally from the mounting plate between the first fastener delivery device and the second fastener delivery device. A cutter (416) extends distally from the mounting plate between the first gatherer and the second gatherer. The translating head includes a complementary cutter (425) to engage the cutter to impart a scissor cutting action as the translating head translates toward the receiver. The translating head can also optionally include a third gatherer (423), a fourth gatherer (424), a first bender (421), and a second bender (422) as well.

19 Claims, 8 Drawing Sheets

(56) References Cited

U.S. PATENT DOCUMENTS 3,381,359 A * 5/1968 Schroeder ..... B65B 51/04 29/243.57
3,412,445 A * 11/1968 Schroeder ..... B65B 51/04 29/33.5
3,543,378 A * 12/1970 Klenz ..... A22C 11/125 29/243.57
3,587,204 A * 6/1971 George ..... B65B 51/04 24/27
3,908,335 A * 9/1975 Giannelli ..... B65B 1/02 53/138.4
3,940,906 A * 3/1976 Leckband et al. ..... B65B 9/13 53/452
4,091,595 A * 5/1978 Pelster et al. ..... B65B 9/13 493/197
4,107,903 A * 8/1978 Wickersheim ..... B65B 9/15 53/138.4
4,223,508 A * 9/1980 Wells ..... B65B 61/06 53/138.4
4,516,379 A * 5/1985 Iain ..... B65B 51/04 53/138.4
4,550,553 A * 11/1985 Gaither ..... B65B 9/15 53/552
4,807,345 A * 2/1989 Jacobson ..... B65B 51/04 29/243.56
4,827,591 A * 5/1989 Arnone ..... B65B 51/04 29/243.56
5,155,976 A * 10/1992 Okabe et al. ..... B65B 9/15 232/44
6,173,483 B1 * 1/2001 Houck et al. ..... E02B 11/005 29/407.09
6,205,747 B1 * 3/2001 Paniagua Olaechea ..... B65B 51/04 53/138.4
6,871,474 B2 * 3/2005 Topfer ..... B65B 51/04 53/138.4
7,216,469 B2 * 5/2007 Kirk et al. ..... B65B 9/15 53/131.2
9,573,708 B2 * 2/2017 Jens ..... B65B 51/04
2003/0073397 A1 * 4/2003 Stanley et al. ..... A22C 11/02 452/35
2003/0208991 A1 * 11/2003 Marks ..... B65B 9/15 53/459
2016/0023788 A1 * 1/2016 Bruck et al. ..... B65B 61/06 53/547
2016/0114975 A1 * 4/2016 Butler et al. ..... B65F 1/062 53/451

FOREIGN PATENT DOCUMENTS

DE 102011118940 A1 * 5/2013 ..... B65F 1/062
FR 2217503 A1 * 9/1974 ..... B65B 9/15
GB 1349298 A * 4/1974 ..... B65B 51/04

* cited by examiner

CUTTING APPARATUS AND ASSOCIATED SYSTEMS

BACKGROUND

Technical Field

This disclosure relates generally to a cutting devices, and more particularly to mechanical cutting devices.

Background Art

In many types of facilities, from health care facilities to hotels to offices, the trash is emptied at least once a day. Frequently, this activity includes removing a trash bag or liner from a waste receptacle, placing it in a large bin, and then lining the waste receptacle with a new bag or liner. While there may be a requirement to empty the trash on a daily basis, it is often the case that this requirement is predicated on a desire to have a clean wastebasket rather than the amount of waste generated. In many instances, only a modicum of waste will be deposited in a particular receptacle. Despite this being the case, the trash bag is removed nightly and replaced with another trash bag.

Illustrating by example, in a hospital a patient might place a tissue or two in a wastebasket during the day. Despite the fact that there are only a couple of tissues in the wastebasket, hygiene and other best practices require that the trash be emptied each day. Accordingly, a trash bag having only two tissues therein is removed and replaced with another. This "small amount of trash per bag" results in a tremendous amount of waste. Unfilled bag after unfilled bag is sent to the landfill. It would be advantageous to have an improved apparatus, system, and method to cut down on the amount of unfilled bags being discarded on a daily basis.

Figure 1:
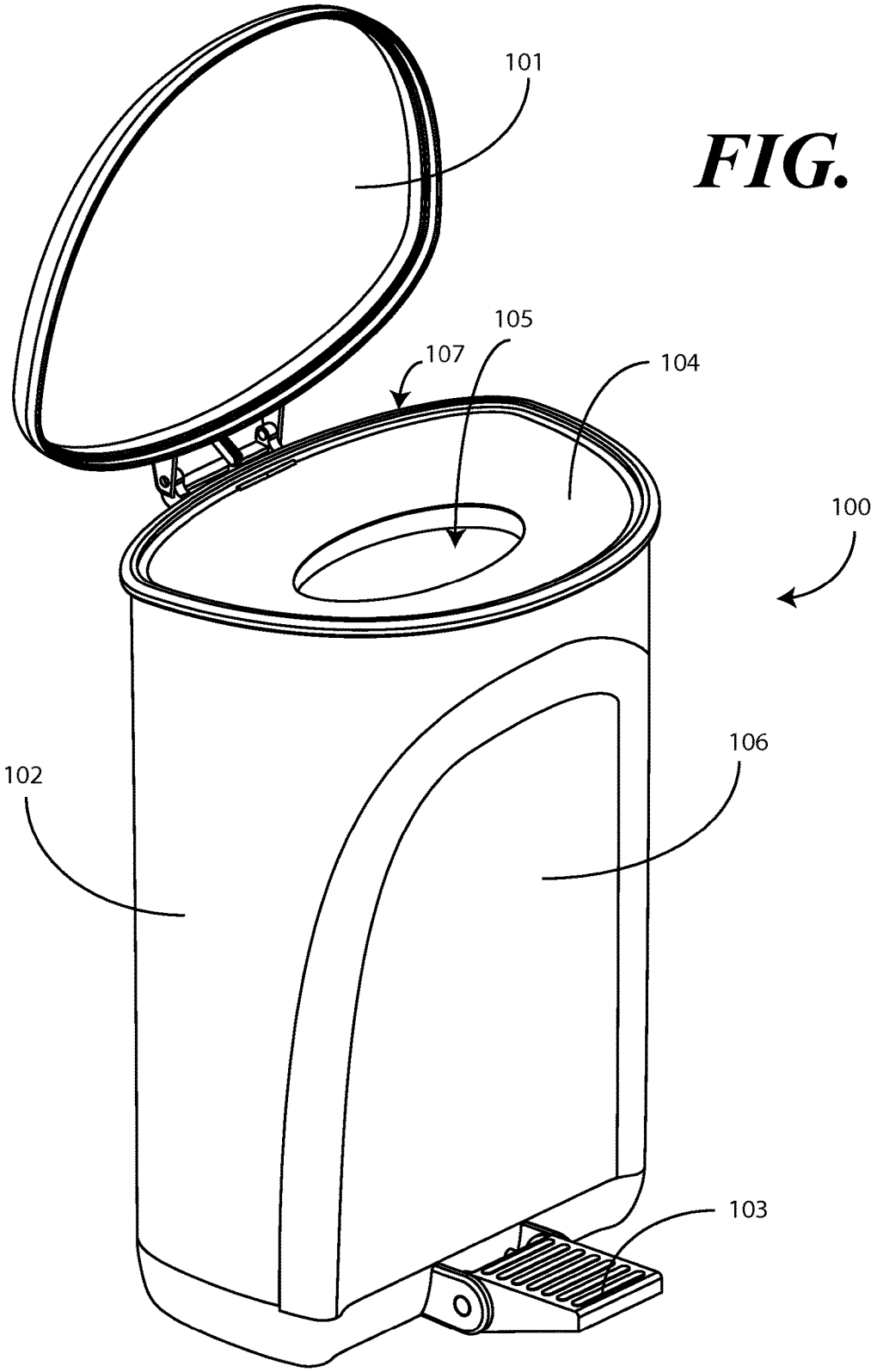
FIG. 1 illustrates one explanatory trash receptacle in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A.

As noted above, a large amount of waste is generated in small trash receptacles, such as trash cans and wastebaskets, due to the premature disposal of a partially-filled trash bag. This is especially true in healthcare and hospitality settings where hygiene practices require the removal of waste between patients or guests regardless of whether the trash bag is full. In many instances, trash bags are discarded with minimal amounts of waste. This results in many bags being discarded for the same amount of waste that would have filled only a single bag under other circumstances. In these instances, disposal of the bag itself becomes the leading cause of waste. Analysis of this situation suggests that in a moderately sized hospital, the excess cost of bags alone can exceed $90,000 annually.

Compounding matters is the fact that people frequently line a wastebasket with a trash bag that is not properly sized. This can happen for a variety if reasons. For example, some purchasing managers simply prefer to order trash bags in a single size to reduce the number of different items in inventory. Other times, a person may inadvertently grab the wrong bag or improperly measure the wastebasket. Regardless of cause, if the trash bag is too large the partially-filled bag results in discarding even more empty bags.

Embodiments of the present disclosure provide a cutting apparatus, associated systems, and methods that reduce the amount of waste generated by unfilled bags. Embodiments of the disclosure do this by providing a tool that will gather, seal, and cut a cylindrical material, such as that forming a trash bag, at any location. Accordingly, rather than discarding a partially filled bag, a user of embodiments of the disclosure can simply place a portion of the bag within a channel and rotate a lever to gather the bag, seal the bag in two places, and cut the bag between the seals. Accordingly, once the device is used, only a small portion of the overall bag needs to be discarded when the bag contains a minimal amount of waste. The remainder of the bag can then be left—with a new seal at the bottom—for future use with no waste whatsoever left in side.

In one embodiment, a cutting device includes a receiver and a translating head. In one embodiment, the translating head is coupled by an arm to a lever that is rotatable about an axis. In such an embodiment, the translating head can be configured to translate toward the receiver when the lever is rotated in a first direction about the axis. In other embodiments, the cutting device can be power operated such that the translating head translates toward the receiver when a user presses a switch, control button or other control mechanism.

In one embodiment, the receiver includes a mounting plate. Attached to the mounting plate can be one or more gathering, cutting, and fastening components. For example, in one embodiment a first fastener delivery device and a second fastener delivery device are coupled to the mounting plate. Between the first fastener delivery device and the second fastener delivery device, a first gatherer and a second gatherer can be mounted to the mounting plate. In one embodiment, each of the first gatherer and the second gatherer extends distally from the mounting plate between the first fastener delivery device and the second fastener delivery device. In one embodiment, a cutter the extends distally from the mounting plate between the first gatherer and the second gatherer.

In one embodiment, the translating head can have complementary components to those found on the receiver. For example, the translating head can include fastener-closing devices that complement the fastener delivery devices. In one embodiment, the translating head includes a first bender and a second bender, aligned with the first fastener delivery device and the second fastener delivery device, respectively, to receive and bend legs of a fastener. Where the fastener is a staple, the benders can receive the legs of the staple to bend those legs about or through a portion of a bag.

Similarly, the translating head can include components that are complementary to the first gatherer and the second gatherer. In one embodiment, the translating head further comprises a third gatherer and a fourth gatherer, aligned with the first gatherer and the second gatherer, respectively. When the translating head translates toward the receiver, the third gatherer can engage the first gatherer by sliding across a major face of the first gatherer to impart a scissor pinching action to gather the bag into a small area so that the fastener can completely seal the bag.

In one embodiment, the third gatherer and the fourth gatherer extend more distally from the translating head toward the receiver than do other components. This results in the third gatherer engaging the first gatherer, and the fourth gatherer engaging the second gatherer before other components engage each other. This ensures that the pinching action to gather the bag into a small area occurs before any fastening or cutting of the bag. The third gatherer and the fourth gatherer can further be biased toward the receiver by a first spring and second spring, respectively. Preloading the third gatherer and the fourth gatherer toward the receiver with the first spring and the second spring allows the third gatherer and the fourth gatherer to compress as the translating head translates toward the receiver, and as the third gatherer engages the first gatherer and the fourth gatherer engages the second gatherer. The first spring and the second spring further 3 compress to gather any cylindrical material, e.g., a trash bag, that may be disposed between the first gatherer and the third gatherer, and the second gatherer and the fourth gatherer, respectively.

In one embodiment, the translating head comprises a cutter that is complementary to the cutter in the receiver. After the third gatherer engages the first gatherer and the fourth gatherer engages the second gatherer, and after the fasteners have been crimped about or through the bag by the benders, the cutter and the complementary cutter can cut the bag. The result is a portion of the bag that is empty remaining in the trash receptacle and a portion containing waste being removed. The portion containing waste is smaller than the bag itself, thereby reducing waste.

While one explanatory application for using embodiments of the disclosure is to gather, fasten, and cut a trash back to reduce overall waste, embodiments of the disclosure are not so limited. Embodiments of the disclosure can be used to gather, fasten, and cut any type of cylindrical material. Accordingly, they can be used in manufacturing processes, textile processes, or other applications. The waste receptacle example is used herein for illustrative purposes only as still other applications will be obvious to those of ordinary skill in the art.

Turning now to FIG. 1, illustrated therein is a waste receptacle 100 configured in accordance with one or more embodiments of the disclosure. The waste receptacle 100 can be used as a trashcan or wastebasket, and includes a lid 101 and a body 102. In one or more embodiments, the lid is actuated by a foot pedal 103. A user steps on the food pedal 103 to raise the lid 101, thereby eliminating the need to touch the lid 101 with their hands. The foot pedal 103 is optional, however, as other waste receptacles may include a lid that a user lifts off or pivots with their hand. Still other waste receptacles may have no lid at all.

In this illustrative embodiment, a disposal surface 104 resides beneath the lid 101. The disposal surface covers a trash bag (not shown in FIG. 1), and defines an aperture 105 into which waste may be placed.

In this illustrative embodiment, the body 102 includes a door 106 that opens so that the trash bag can be removed. Other waste receptacles may allow removal of the trash bag through the top 107 of the body 102. Still other configurations will be obvious to those of ordinary skill in the art having the benefit of this disclosure.

In one embodiment, the body 102 and lid 101 are manufactured from metal. In another embodiment, the body 102 and lid 101 are manufactured from a thermoplastic material. The components of the waste receptacle 100 can be manufactured from common materials, or from different materials. For example, in one embodiment the body 102 and lid 101 are manufactured from plastic, while the disposal surface 104 is manufactured from metal, and so forth. Other configurations will be obvious to those of ordinary skill in the art having the benefit of this disclosure.

Figure 2:
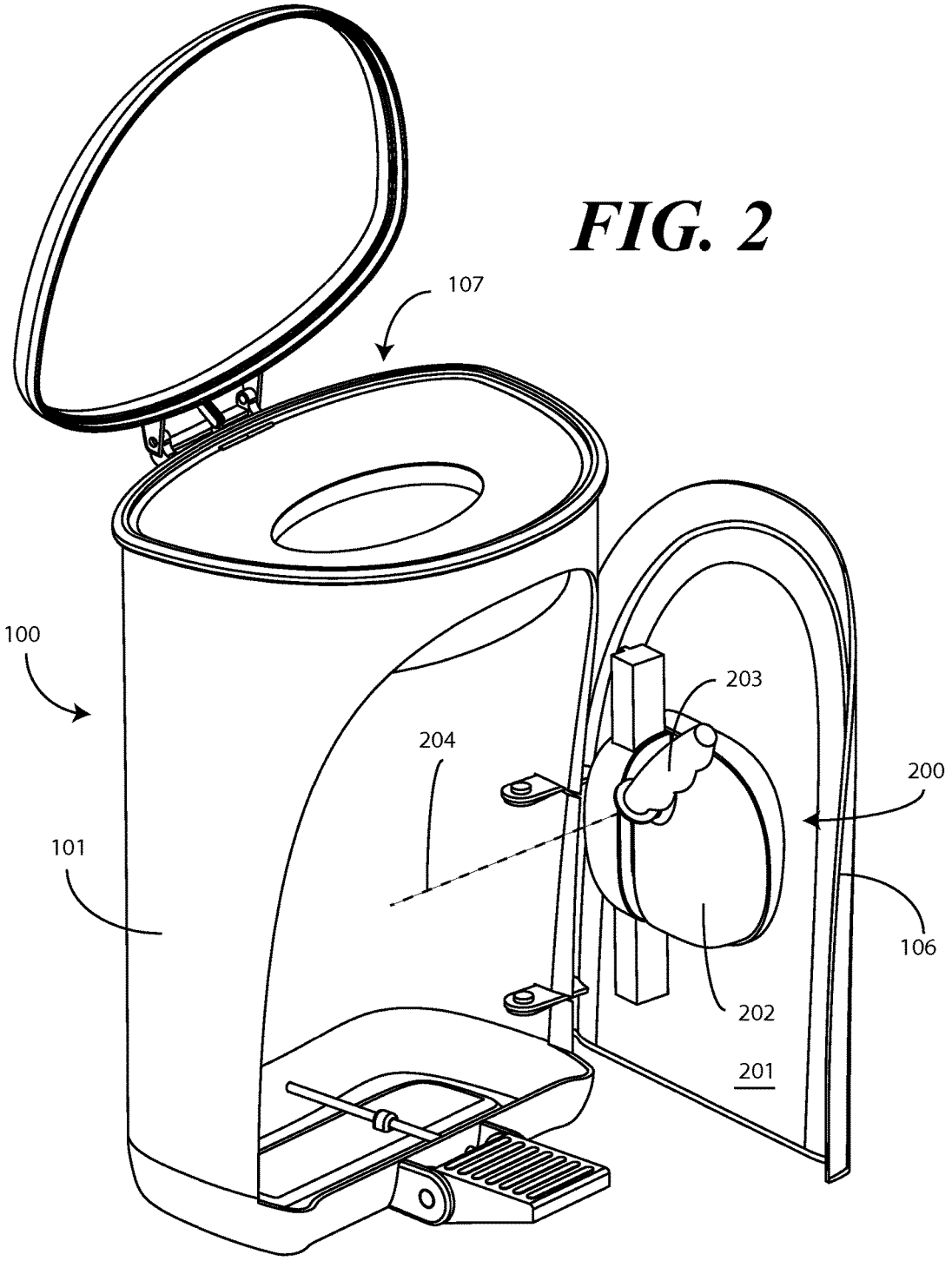
FIG. 2 illustrates another view of an explanatory trash receptacle in accordance with one or more embodiments of the disclosure.

Turning now to FIG. 2, the door 106 of the waste receptacle 100 has been opened. In one embodiment, a cutting device 200 is coupled to the interior surface 201 of the door 106. It should be noted that while the cutting device 200 is attached to the interior surface 201 of the door 106 in this illustrative embodiment, embodiments of the disclosure are not so limited. In another embodiment, the cutting device 200 can be configured as a standalone device. In yet another embodiment, the cutting device 200 can be stowed in a pouch, pocket, holster, or hook disposed along an interior surface of the waste receptacle 100. In still other embodiments, the cutting device 200 could be coupled to other locations of the waste receptacle 100. However, in one or more embodiments attaching the cutting device 200 to the interior surface 201 of the door 106 is advantageous in that it disposes the cutting device 200 in a convenient location for cutting potions of trash bags extending downward from the top 107 of the body 101 of the waste receptacle 100.

Figure 4:
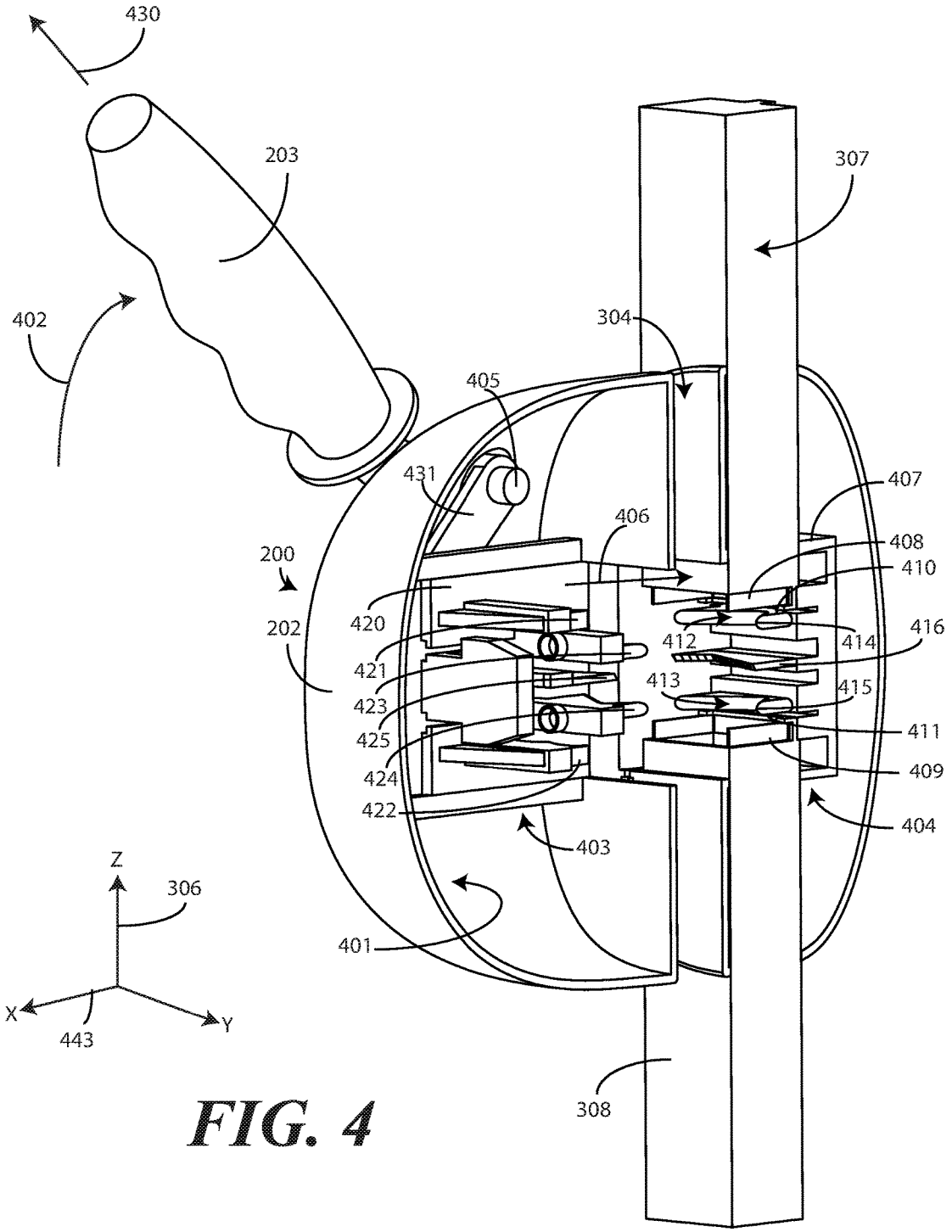
FIG. 4 illustrates another view of an explanatory cutting apparatus in the open position in accordance with one or more embodiments of the disclosure.
Figure 5:
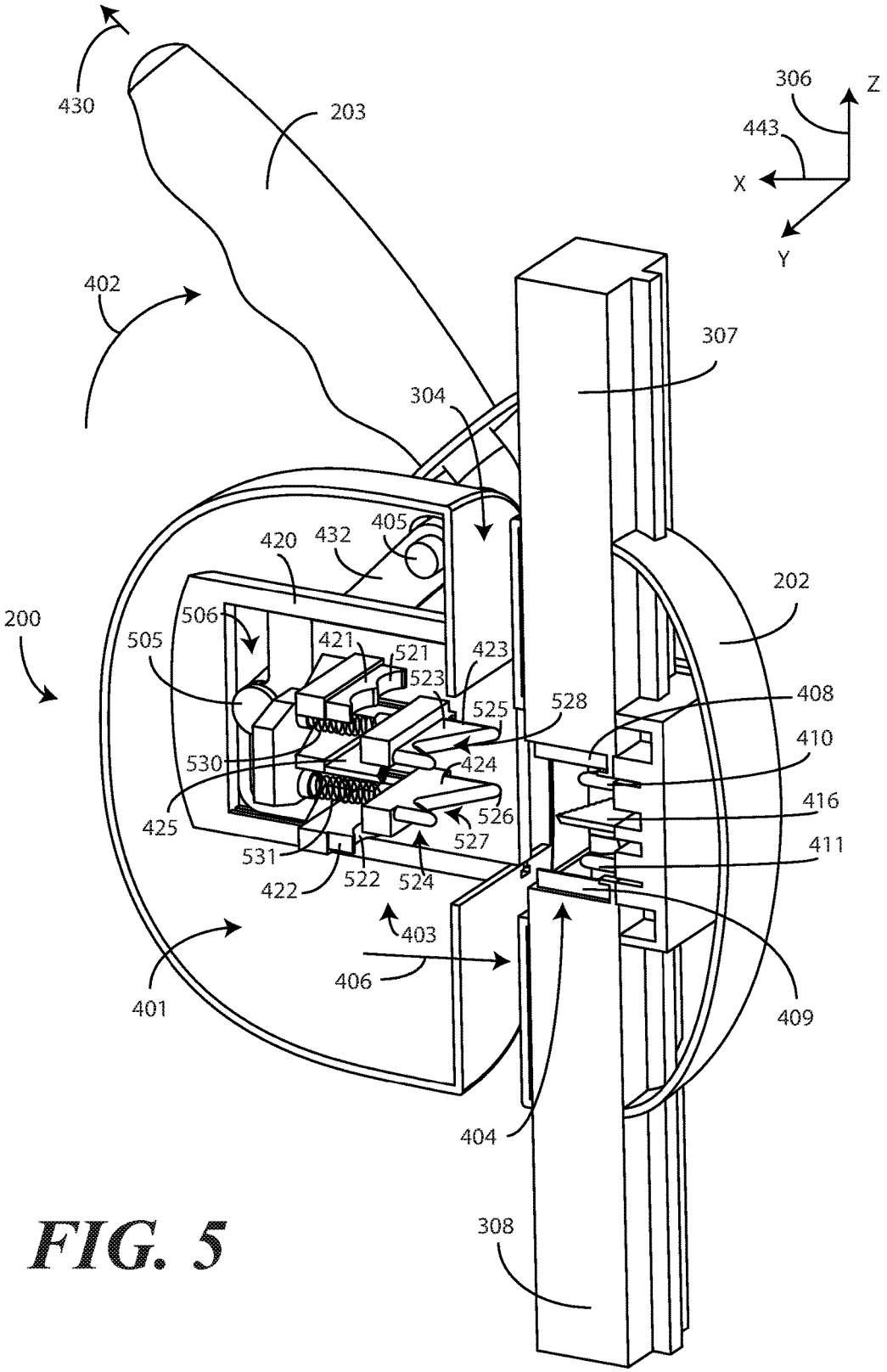
FIG. 5 illustrates another view of an explanatory cutting apparatus in the open position in accordance with one or more embodiments of the disclosure.
Figure 6:
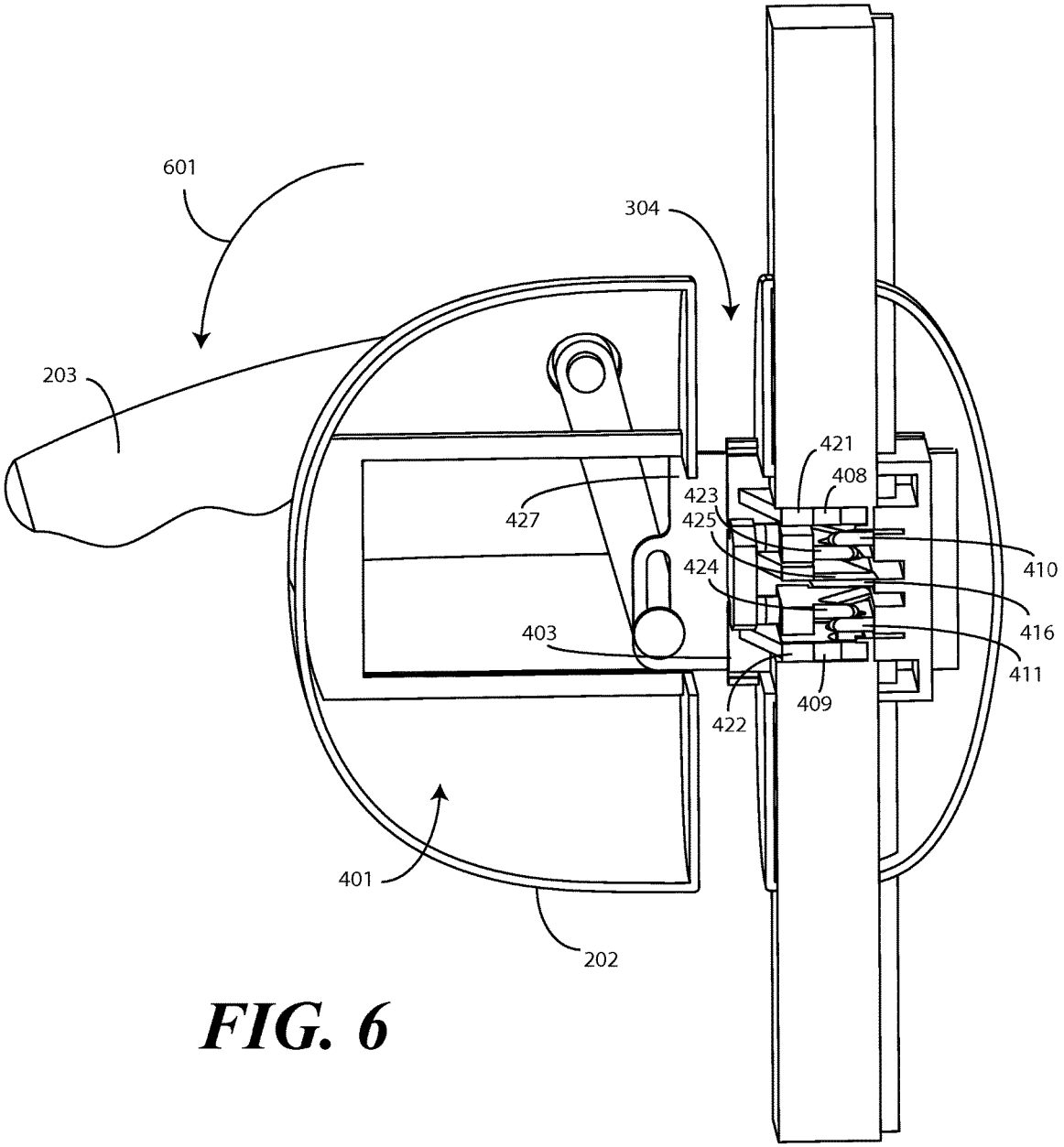
FIG. 6 illustrates a view of an explanatory cutting apparatus in a closed position in accordance with one or more embodiments of the disclosure.

As shown in FIG. 2, the cutting device 200 includes a housing 202 and a lever 203 in this illustrative embodiment. This forms a mechanically powered cutting device that operates when the lever 203 pivots about an axis 204. However, embodiments of the disclosure are not so limited. The lever 203 could be replaced by an electric motor such that the cutting device 200 operates when a user actuates a switch or other control device. Still other mechanisms for actuating the cutting device 200 will be obvious to those of ordinary skill in the art having the benefit of this disclosure.

Where the cutting device 200 is attached to the interior surface 201 of the door 106, as is the case in the illustrative embodiment of FIG. 2, the cutting device 200 can be so attached in a variety of ways. In one embodiment, components of the cutting device 200, which will be described in more detail below with reference to FIGS. 4-6, are integrally coupled to the housing 202, with the housing attaching to the interior surface 201 of the door 106 with snap-fit features. In other embodiments, the housing 202 can be adhesively attached to interior surface 201 of the door 106. In still other embodiments, the housing can be thermally bonded, such as through a sonic or thermal welding process, to the interior surface 201 of the door 106. Other attachment techniques will be obvious to those of ordinary skill in the art having the benefit of this disclosure.

As with the materials of the can, the materials of the housing 202 of the cutting device 200 can take a variety of forms. In one embodiment, the housing 202 is manufactured from a thermoplastic material. In another embodiment, the housing 202 is manufactured from metal. Other materials can be used as well The cutting device 200 is shown in a magnified view in FIG. 3. While the cutting device 200 can take a variety of dimensions, explanatory dimensions for waste basket bags provide a cutting device with a width 301 of about 250 millimeters, a height 302 of about 155 millimeters, and a depth 303 of about 50 millimeters. Those of ordinary skill in the art having the benefit of this disclosure will understand that other applications, e.g., an industrial cutting operation cutting industrial textiles for example, would require a much larger cutting device. While the scale may change, the components described herein remain the same and would work as described below.

Figure 3:
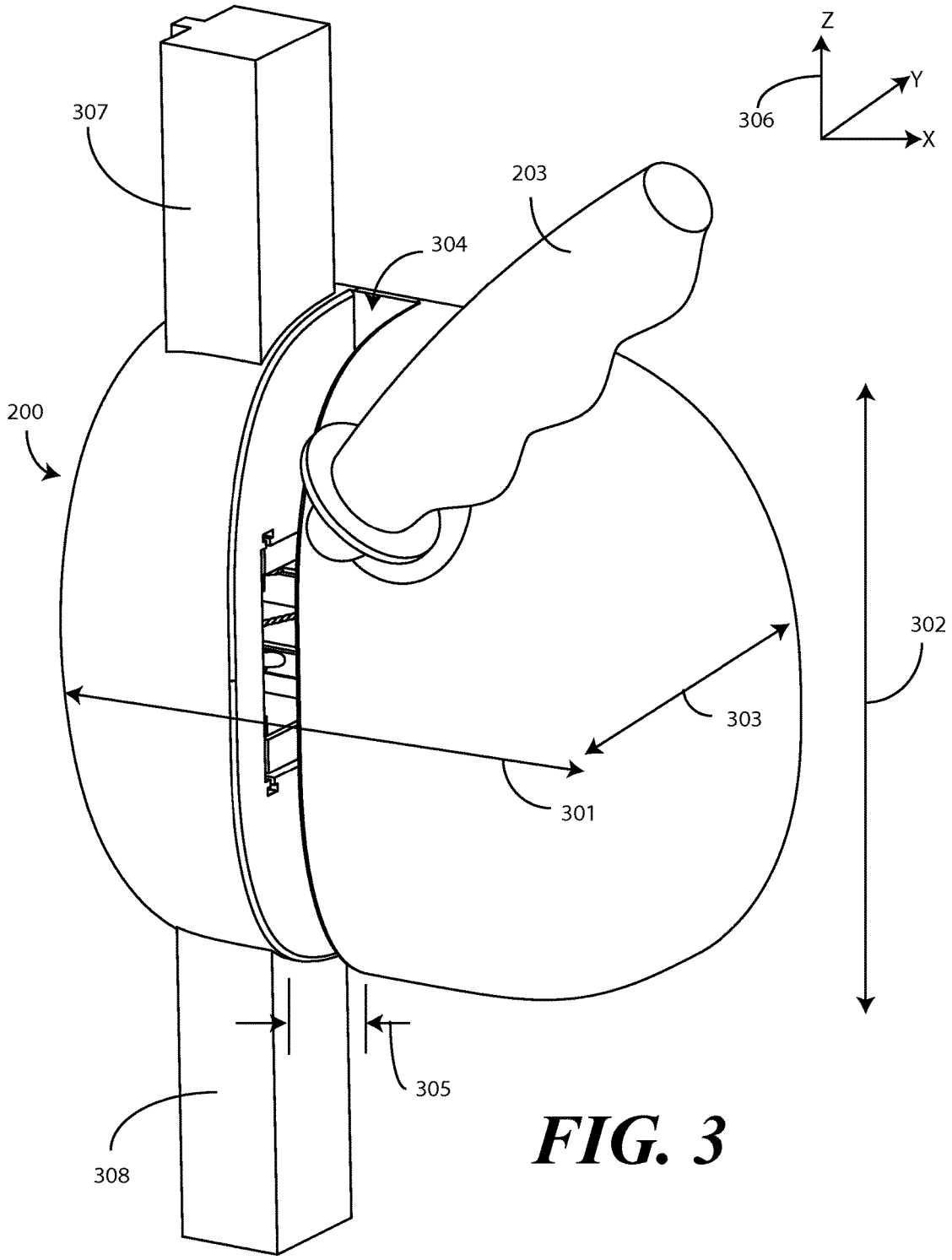
FIG. 3 illustrates a first view of an explanatory cutting apparatus, in an open position, in accordance with one or more embodiments of the disclosure.

As shown in FIG. 3, in one embodiment, the housing 202 defines a channel 304 into which a cylindrical material can be inserted. In one embodiment, the channel 304 has a width 305 of about 20 millimeters. Testing and analysis has shown that this width 305 is sufficient for trash bags to fully insert into the channel 304 while preventing a user from placing their fingers in the way of the cutters shown below in FIGS. 4-6.

Extending along the z-axis 306 from the housing 202 are two fastener delivery devices 307,308. In one or more embodiments, these fastener delivery devices 307,308 are selectively removable from the housing 202. Each fastener delivery device 307,308 houses one or more fasteners for delivery to the cutting device 200. As will be described below, in one embodiment the fasteners are staples. However, other fasteners, including clamps, zip ties, compression rings, and the like can be used as well. Still other fasteners will be obvious to those of ordinary skill in the art having the benefit of this disclosure. For example, where the lever 203 was replaced with an electric motor, since electricity is being delivered to the cutting device 200, the fastener delivery devices 307,308 may be replaced with heat staking devices to heat seal a trash bag rather than staple it.

Turning now to FIGS. 4-5, the interior 401 of the housing 202 is shown in various views so that the interior components of the cutting device 200 can be seen. In each of FIGS. 4-5, the cutting device 200 is shown in an open position 430 with the lever 203 fully rotated 402 upward. In one or more embodiments, the lever 203 can be preloaded with a spring or other compression device to bias the lever 203 to the open position 430. FIG. 4 provides a left, rear perspective view of the interior 401 of the housing 202, while FIG. 6 provides a right perspective view thereof.

As shown in FIGS. 4-5, in one embodiment the cutting device 200 includes a receiver 404 and a translating head 403. In this illustrative embodiment, the translating head 403 is coupled by an arm 431 to the lever 203. The arm 431 terminates at a pivot pin 405 coupled to the lever 203 at a first end. When the lever 203 rotates about the axis (204), the arm 431 is free to pivot about the pivot pin 405.

The second end of the arm 431 terminates at a slide pin 505 disposed within a slot 506 on the translating head 403. When the lever 203 rotates about the axis (204) and the first end of the arm 431 pivots about the pivot pin 405, the slide pin 505 slides downward within the slot 506 to translate 406 the translating head 403 toward the receiver 404. As noted above, this lever 203—arm 431—pin assembly could be replaced with an electric motor, pneumatic motor, or other piston type device that drives the translating head 403 toward the receiver 404 in response to user actuation of a switch, button, or other control device. The mechanically driven embodiment is simply used herein for illustrative purposes and for brevity.

As best seen in FIG. 4, in one embodiment the receiver 404 includes a mounting plate 407. Various components used to perform different actions can be attached to the mounting plate 407. Also, note that while one illustrative arrangement, i.e., fastener—gatherer—cutter—gatherer—fastener, is described for illustrative purposes, the components attached to the mounting plate 407 could be rearranged. Additionally, more components than those described could be attached to the mounting plate 407, as could fewer in other embodiments.

In the illustrative embodiment of FIGS. 4-5, the first fastener delivery device 307 and a second fastener delivery device 308 are attached to or coupled to the mounting plate 407. As noted above, in one embodiment each fastener delivery device 307,308 is configured to deliver a fastener 408,409 to the cutting device 200 to fasten a cylindrical length of material such as a trash bag. In this illustrative embodiment, the fastener 408,409 is a staple. Accordingly, the fastener delivery devices 307,308 each comprise spring-loaded staple housings designed to feed staples into the cutting device along the z-axis 306.

In one embodiment, a first gatherer 410 and a second gatherer 411 are coupled to the mounting plate 407 between the fastener delivery devices 307,308. In one embodiment, the first gatherer 410 and the second gatherer 411 each extend distally from the mounting plate 407 toward the translating head 403 between the first fastener delivery device 307 and the second fastener delivery device 308. Each gatherer 410,411 is configured to catch and gather cylindrical material placed within the channel 304.

In this illustrative embodiment, each gatherer 410,411 is configured as a v-shaped translating wedge 412,413. The leading edge of the v-shaped wedge 412,413 in this embodiment is configured as a convex engagement surface 414,415. The convex engagement surface 414,415 gathers cylindrical material disposed within the channel 304 when the lever 203 rotates about the axis (204) and the first end of the arm 431 pivots about the pivot pin 405, thereby causing the slide pin 505 to slide downward within the slot 506 to translate 406 the translating head 403 toward the receiver 404 without tearing the cylindrical material. Rather than a v-shaped wedge 412,413, the gatherers 410,411 can take other shapes as well, including concave semicircles, concave free form shapes, and so forth.

In one embodiment, a cutter 416 is also coupled to the mounting plate 407. In this illustrative embodiment, the cutter 416 extends distally from the mounting plate 407 between the first gatherer 410 and the second gatherer 411. The cutter 416 can take various forms. For example, in one embodiment the cutter 416 can be configured as a simple straight blade. In one or more embodiments, the cutter 416 comprises a convex blade to add a gathering action while cutting. In this illustrative embodiment, the cutter 416 comprises a v-shaped, serrated blade 417, as it has been shown to provide a superior cut to thermoplastic materials such as trash bags.

Disposed opposite the channel 304 from the receiver 404 when the lever 203 is rotated 402 to the open position 430 is the translating head 403. As with the receiver 404, the translating head includes a mounting plate 420 to which various components can be attached. Each component performs a different function when the cutting device 200 is in operation. As with the receiver 404, while one illustrative arrangement of components, i.e., bender—gatherer—cutter—gatherer—bender, is described for illustrative purposes, the components attached to the mounting plate 420 could be rearranged. Additionally, more components than those described could be attached to the mounting plate 420, as could fewer in other embodiments. Different components could be attached to perform different functions as well.

In this illustrative embodiment the translating head 403 includes a first bender 421 and a second bender 422. The first bender 421 and the second bender 422 are aligned along the X-axis with the first fastener 408 delivered by the first fastener delivery device 307 and the second fastener 409 delivered by the second fastener delivery device 308, respectively. Each of the first fastener delivery device 307 and the second fastener delivery device 308 is to deliver a fastener 408,409 to the first bender 421 and the second bender 422, respectively. Here, each bender 421,422 is configured with a double-concave batwing surface 521,522 that is to receive, at the outer portions of the double-concave gullwing surface 521,522, legs of each fastener 408,409. As the translating head 403 moves toward the receiver 404, the contours of the double-concave gullwing surface 521,522 then bend legs of each fastener 408,409.

However, in one embodiment, before this bending of the fasteners 408,409 occurs, gatherers gather the material to be fastened. In this illustrative embodiment, the translating head 403 further includes a third gatherer 423 and a fourth gatherer 424. Here the third gatherer 423 and the fourth gatherer 424 are disposed between the first bender 421 and the second bender 422. In one embodiment, the third gatherer 423 and the fourth gatherer 424 are aligned along the x-axis with the first gatherer 410 and the second gatherer 411, respectively, with an offset equal to the thickness of a gatherer.

In one embodiment, the offset for the third gatherer 423 is equivalent to the thickness of the first gatherer 410 in the negative direction along the Z-axis 306, while the offset for the fourth gatherer 424 is equivalent to the thickness of the second gatherer 411 in the positive direction along the Z-axis 306. This offset, as will be shown below with reference to FIG. 6, allows the upper major face 523 of the third gatherer 423 to slide beneath the first gatherer 410, while the lower major face 524 of the fourth gatherer 424 slides above the second gatherer 411 when the translating head 403 translates toward the receiver 404 to gather material disposed within the channel 304 prior to any cutting or fastening.

As the third gatherer 423 and the fourth gatherer 424 have a convex engagement surface 525,526 like the first gatherer 410 and the second gatherer 411, and as each of the third gatherer 423 and the fourth gatherer 424 is also configured as a v-shaped translating wedge 526,527, this sliding of major faces of oppositely facing gatherers together as the translating head 403 moved toward the receiver 404 results in a scissor pinching action. Note that a scissor pinching action is different from a scissor cutting action as the convex engagement surfaces 414,415,525,526 prevent the material from being cut. Said differently, the third gatherer 423 engages the first gatherer 410 to impart a scissor pinching action as the translating head 403 translates toward the receiver 404. Similarly, the fourth gatherer 411 engages the second gatherer 424 to impart another scissor pinching action as the translating head 403 translates toward the receiver 404 when the lever 203 rotates about the axis (204) and the first end of the arm 431 pivots about the pivot pin 405, thereby causing the slide pin 505 to slide downward within the slot 506 to translate 406 the translating head 403 toward the receiver 404 without tearing the cylindrical material. Rather than a v-shaped translating wedge 526,527, the third gatherer 423 and the fourth gatherer 424 can take other shapes as well, including concave semicircles, concave free form shapes, and so forth.

In one embodiment, disposed between the third gatherer 423 and the fourth gatherer 424 is a complementary cutter 425. The complementary cutter 425 is to engage the cutter 416 to impart a scissor cutting action as the translating head 403 translates toward the receiver 404. As with the cutter 416, the complementary cutter 425 can take various forms. For example, in one embodiment the complementary cutter 425 can be configured as a simple straight blade. In one or more embodiments, the complementary cutter 425 comprises a convex blade to add a gathering action while cutting. In this illustrative embodiment, the complementary cutter 425, like the cutter 416, comprises a v-shaped, serrated blade 527. Such a blade has been shown to provide a superior cut to thermoplastic materials such as trash bags.

As can be best seen in FIG. 5, in one embodiment the third gatherer 423 and the fourth gatherer 424 extend more distally from the translating head 403 toward the receiver 404 along the negative X-axis 423 than does the complementary cutter 425. This design results in the third gatherer 423 engaging the first gatherer 410, and the fourth gatherer 424 engaging the second gatherer 411, before the complementary cutter 425 engages the cutter 416 as the translating head 403 translates toward the receiver 404. Said differently, in one embodiment the cutting device 200 gathers before it cuts to provide a cleaner, more reliable cut of material placed within the channel 304 as the translating head 403 translates toward the receiver 404 when the lever 203 is rotated in a first direction (counterclockwise in FIGS. 4 and 5) about an axis (204).

In one embodiment, to allow the complementary cutter 425 to engage the cutter 416 despite the third gatherer 423 and the fourth gatherer 424 extend more distally from the translating head 403 toward the receiver 404 along the negative X-axis 423 than does the complementary cutter 425, one pair of gatherers is spring loaded. In this illustrative embodiment, the third gatherer 423 and the fourth gatherer 424 are biased toward the receiver 404 by a first spring 530 and second spring 531, respectively. In such a configuration, the first spring 530 and the second spring 531 compress as the translating head 403 translates toward the receiver 404 to engage the third gatherer 423 and the first gatherer 410, and the fourth gatherer 424 and the second gatherer 411 to allow the benders 421,422 to bend the fasteners 408,409 and the cutter 416 to engage the complementary cutter 425.

As shown in both FIG. 5 and FIG. 6, the housing 202 is disposed about the translating head 403 and the receiver 404. The housing defines the channel 304, which is disposed between the translating head 403 and the receiver 404. The channel 304 is to receive a cylindrical material, such as a trash bag. The translating head 403 translates toward the receiver 403 to gather the cylindrical material at two locations when the third gatherer 423 and the first gatherer 410 engage at a first location and the fourth gatherer 424 and the second gatherer 411 engage at a second location. The cutting device 200 then cuts the cylindrical material at one location when the cutter 416 engages the complementary cutter 425. The cutting device 200 also fastens the cylindrical material at two other locations when the translating head translates toward the receiver when the benders 421,422 bend the legs of fasteners 408,409 delivered by the fastening delivery devices 307,308.

Turning now to FIG. 5, the lever 203 has been rotated 601 about the axis (204) in a first direction, thereby translating the translating head 403 toward the receiver 404 and across the channel 304. The third gatherer 423 has engaged the first gatherer 410, while the fourth gatherer 424 has engaged the second gatherer 411 to impart a scissor pinching action. The cutter 416 has engaged the complementary cutter 425 to impart a scissor cutting action. The benders 421,422 have bent the legs of the fasteners 408,409 delivered by the fastening delivery devices 307,308, thereby completing the gather-fasten-cut process. The base member 421 functions as a door across the channel 304 to prevent a user from placing their fingers in front of the translating head 403 as it translates toward the receiver 404.

Figure 7:
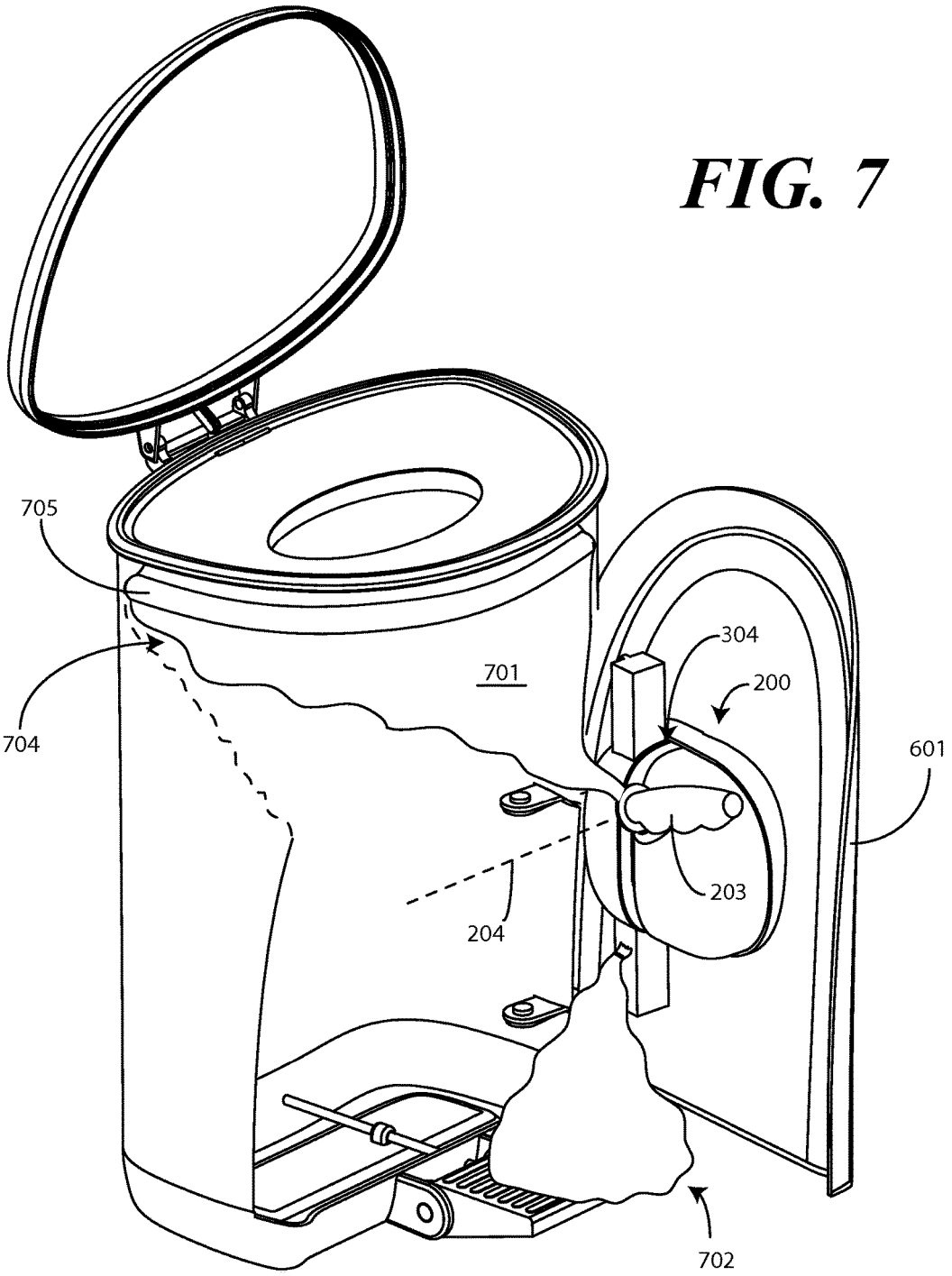
FIG. 7 illustrates an explanatory cutting apparatus in accordance with one or more embodiments of the disclosure in use.
Figure 8:
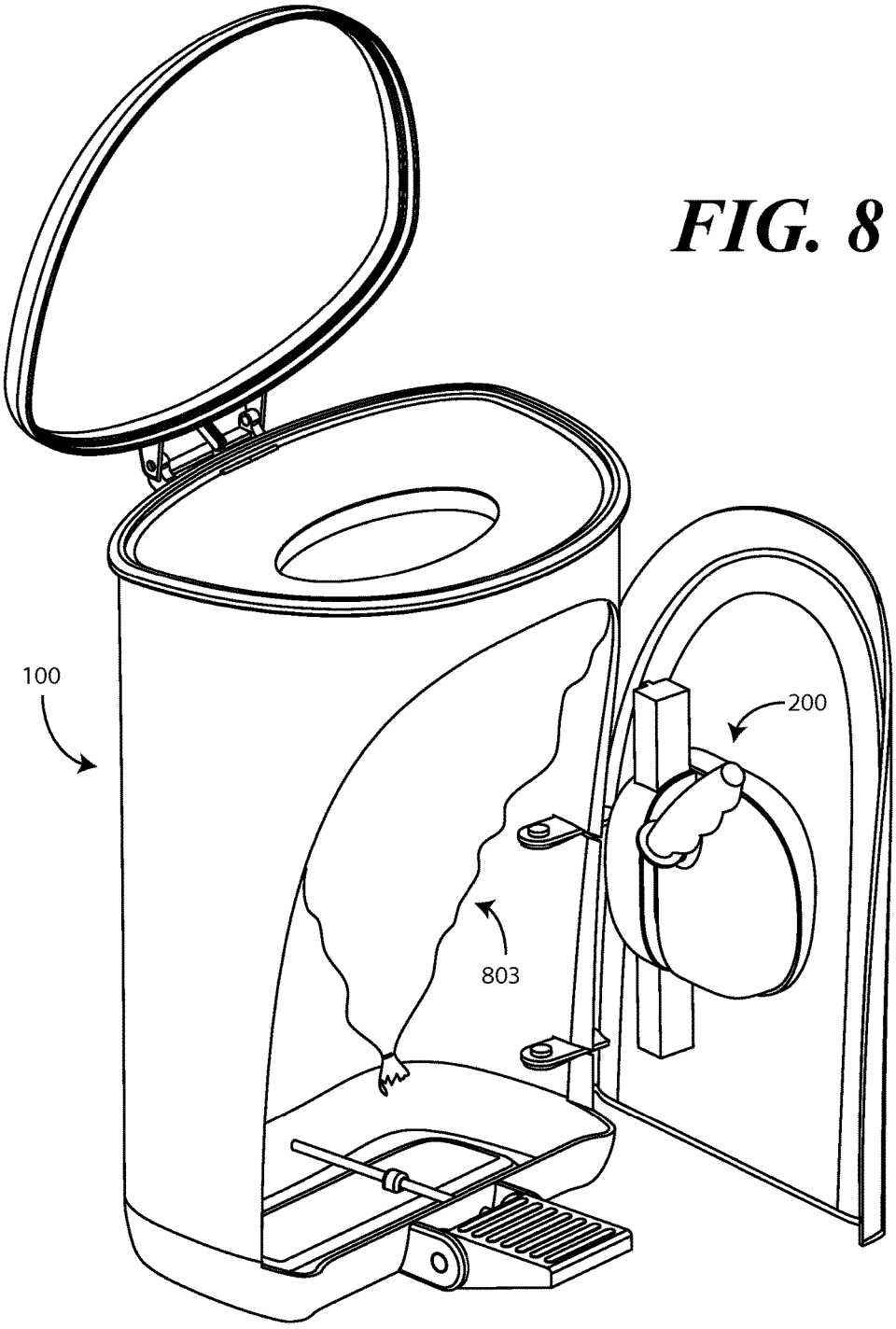
FIG. 8 illustrates an explanatory cutting apparatus in accordance with one or more embodiments of the disclosure after use.

Turning now to FIGS. 7 and 8, illustrated therein are method steps for using the cutting device 200. As shown in FIG. 7, a user first gathers a trash bag 701 and places it within the channel 304. The user then rotates 601 the lever 203 about the axis 204 to perform the gather-fasten-cut process described in the preceding paragraph. A small portion 702 of the trash bag 701 is cut and sealed with whatever small amount of rubbish may be inside. As shown in FIG. 8, the remaining trash bag 803 remains in the trash receptacle 100. However, it has been cut and sealed, thereby rendering it ready for new use. By disposing of only the small portion 702 of the trash bag 701, waste is eliminated. As shown in FIG. 7, to allow for fewer loadings of trash bag material, a continuous cylindrical trash bag liner 704 can be fed from a roll 705. This allows a user to cut off portions of bags without having to reload the trash receptacle 100 with a new bag so readily.

As shown and described above, a cutting device 200 gathers, seals, and cuts a trash bag 701 at any location. Different components, e.g., gatherers (410,411,423,424), cutters (416,425), benders (421,422), and fastener delivery devices (308,309) work together to gather portions of a trash bag 701 together, seal the bag shut above or below the gathering point, and cut the bag cleanly between seals. The gatherers (410,411,423,424) can be spring-loaded to allow them to engage the trash bag 701 before the cutters (416, 425) and to increase the gathering force about the trash bag 701.

In one or more embodiments, the cutting device 200 can be operated by a single lever 203. At the end of the lever 203 is a sliding pin 505 that translates in a slot (506) disposed along a base plate 420 of a translating head 403. As the lever 203 rotates 601 about an axis 204, the translating head 403 moves toward a receiver so that the gatherers (410,411,423, 424), cutters (416,425), benders (421,422), and fastener delivery devices (308,309) can perform the gather-fasten-cut process. Fastener deliver devices (308,309) can be spring loaded to deliver fasteners (408,409) into the cutting device 200. The fasteners (408,409) sit within a small overhang to be aligned along an X-axis (423) with the benders (421,422). Legs of the fasteners (408,409) can be fully exposed so that they can be bent by the gullwing surface (521,522) of the benders (421,422).

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. For example, additional features could be included in the cutting device. For example, the cutters (416,425) could be configured as self-sharpening cutters for extended life. The fastener delivery devices (307,308) can allow loading of fasteners (408,409) with a spring loaded locking clip. Alternatively, portions of the fastener delivery devices (307,308) can pivot open like a children's candy dispenser to allow loading of the fasteners (408,409).

Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A cutting device, comprising:
a receiver; and
a translating head;
the receiver comprising:
a mounting plate;
a first fastener delivery device and a second fastener delivery device coupled to the mounting plate;
a first gatherer and a second gatherer, each extending distally from the mounting plate between the first fastener delivery device and the second fastener delivery device; and
a cutter extending distally from the mounting plate between the first gatherer and the second gatherer;
the translating head comprising a complementary cutter to engage the cutter to impart a scissor cutting action as the translating head translates toward the receiver.

2. The cutting device of claim 1, the translating head further comprising a first bender and a second bender, aligned with a first fastener from the first fastener delivery device and a second fastener from the second fastener delivery device, respectively, to receive and bend legs of the first fastener and the second fastener, respectively.

3. The cutting device of claim 2, the translating head further comprising a third gatherer and a fourth gatherer, aligned with the first gatherer and the second gatherer, respectively, with an alignment offset of a thickness of the first gatherer or the second gatherer.

4. The cutting device of claim 3, the third gatherer to engage the first gatherer to impart a scissor pinching action as the translating head translates toward the receiver; and the fourth gatherer to engage the second gatherer to impart another scissor pinching action as the translating head translates toward the receiver.

5. The cutting device of claim 4, the cutter and the complementary cutter each comprising a convex blade.

6. The cutting device of claim 5, the convex blade comprising a v-shaped, serrated blade.

7. The cutting device of claim 5, each of the first gatherer, the second gatherer, the third gatherer, and the fourth gatherer comprising a v-shaped wedge.

8. The cutting device of claim 7, the v-shaped wedge having a convex engagement surface.

9. The cutting device of claim 7, each of the first fastener delivery device and the second fastener delivery device to deliver the first fastener to the first bender and the second fastener to the second bender, respectively.

10. The cutting device of claim 9, the first fastener and the second fastener each comprising a staple.

11. The cutting device of claim 9, further comprising a lever coupled to the translating head by one or more arms, the translating head to translate toward the receiver when the lever is rotated in a first direction about an axis.

12. The cutting device of claim 11, the third gatherer and the fourth gatherer extending more distally from the translating head toward the receiver than the complementary cutter such that the third gatherer engages the first gatherer and the fourth gatherer engages the second gatherer before the complementary cutter engages the cutter as the translating head translates toward the receiver.

13. The cutting device of claim 12, the third gatherer and the fourth gatherer biased toward the receiver by a first spring and second spring, respectively, the first spring and the second spring to compress as the translating head translates toward the receiver to engage the third gatherer and the first gatherer and the fourth gatherer and the second gatherer.

14. The cutting device of claim 13, the first spring and the second spring to compress to gather a cylindrical material disposed between the first gatherer and the third gatherer, and the second gatherer and the fourth gatherer, respectively.

15. The cutting device of claim 12, further comprising a housing disposed about the translating head and the receiver, the housing defining a channel between the translating head and the receiver.

16. The cutting device of claim 15, the channel to receive a cylindrical material, the translating head to gather the cylindrical material at two locations, cut the cylindrical material at one location, and fasten the cylindrical material at two other locations when the translating head translates toward the receiver.

17. The cutting device of claim 15, the housing coupled to a trash receptacle.

18. The cutting device of claim 17, the housing coupled to an openable door of the trash receptacle.

19. The cutting device of claim 18, the cylindrical material comprising a trash bag.

* * * * *